US010283291B2

(12) United States Patent
Poon

(10) Patent No.: US 10,283,291 B2
(45) Date of Patent: May 7, 2019

(54) WATERPROOF TOGGLE SWITCH

(71) Applicants: DEFOND ELECTECH CO., LTD, Guangdong (CN); DEFOND COMPONENTS LIMITED, Chaiwan (CN)

(72) Inventor: Kai Kei Poon, Chaiwan (CN)

(73) Assignees: DEFOND ELECTECH CO., LTD, Guangdong (CN); DEFOND COMPONENTS LIMITED, Chaiwan (CN)

( * ) Notice: Subject to any disclaimer, the term of this patent is extended or adjusted under 35 U.S.C. 154(b) by 0 days.

(21) Appl. No.: 15/684,662

(22) Filed: Aug. 23, 2017

(65) Prior Publication Data

US 2018/0102227 A1 Apr. 12, 2018

(30) Foreign Application Priority Data

Oct. 8, 2016 (CN) ..... 2016 1 0882774

(51) Int. Cl.
*H01H 23/06* (2006.01)
*H01H 23/14* (2006.01)

(52) U.S. Cl.
CPC ..... *H01H 23/06* (2013.01); *H01H 23/141* (2013.01)

(58) Field of Classification Search
CPC ..... H01H 23/06
USPC ..... 200/302.3
See application file for complete search history.

(56) References Cited

U.S. PATENT DOCUMENTS 4,533,803 A * 8/1985 Beller ..... H01H 23/28 200/276
4,710,599 A * 12/1987 Motodate ..... B60Q 1/1476 200/296
5,117,074 A * 5/1992 Yanai ..... H01H 9/04 200/302.1
5,662,213 A * 9/1997 Kattler ..... H01H 23/06 200/302.3
5,900,584 A * 5/1999 Cady ..... H01H 23/141 174/66
6,380,500 B1 * 4/2002 Lin ..... H01H 23/065 200/302.1
7,494,371 B2 * 2/2009 Kidman ..... H01R 13/506 174/66
2009/0020402 A1 * 1/2009 Ichikawa ..... H01H 13/06 200/341

* cited by examiner

*Primary Examiner* — Kyung S Lee
(74) *Attorney, Agent, or Firm* — Marshall, Gerstein & Borun LLP

(57) ABSTRACT

Provided is a waterproof toggle switch, which includes a panel, a shift lever, a fixed contact and an elastic element. The panel is provided with an opening portion, with the opening portion running through the panel, between a front wall surface and a rear wall surface of the panel. The shift lever is rotatably held in the opening portion of the panel, and the shift lever includes a rotation center portion, a driving portion and an operation portion. A fit clearance between the rotation center portion and the opening portion ranges from 0.02 mm to 0.2 mm. By providing the panel with the opening portion and providing the shift lever with the rotation center portion, and by controlling the fit clearance between the opening portion and the rotation center portion, a waterproof toggle switch having superperformance and a low cost is provided.

10 Claims, 8 Drawing Sheets

WATERPROOF TOGGLE SWITCH

CROSS-REFERENCE TO RELATED APPLICATION

The present application claims priority to Chinese Application No. 201610882774.0, filed Oct. 8, 2016. The priority application, CN 201610882774.0, is hereby incorporated by reference.

TECHNICAL FIELD

The present invention relates to the technical field of switches, and particularly to a waterproof toggle switch.

BACKGROUND ART

A switch is an electronic element which enables, through mechanical switching, a circuit to be switched on or off. Switches are widely used in various technical fields, such as instrumentation equipment, and electrical and electronic products, and they are indispensable for either manufacture or daily life.

With the improvement of the living standards, there are more and more kitchen and bathroom electrical products. The humid environment in the kitchen and bathroom easily causes potential safety hazards such as electric leakage. In particular, a user may often operate the switch with a wet hand. If the waterproof performance of the switch is poor, it will inevitably cause an electric shock to the user or cause damage to the electrical products, which will pose a serious threat to both personal and property safety of the user. In order to solve such problem of electric safety, the waterproof toggle switch is developed.

At present, a commercially available waterproof toggle switch is mainly implemented by adding a waterproof cover outside a switch. Although such structure greatly improves the safety, the operation convenience is reduced. Moreover, the use of the waterproof cover also increases the manufacturing cost of the switch and prolongs the production cycle, which is unfavorable to the improvement of productivity.

DISCLOSURE OF THE INVENTION

In order to overcome the defects in the prior art, the present invention provides a waterproof toggle switch, which solves the security issues caused by the humid environment and the operation with wet hands, with an extremely low cost.

The object of the present invention is achieved by the technical solutions as follows.

A waterproof toggle switch is provided, which includes:

a panel provided with an opening portion, with the opening portion running through the panel, between a front wall surface and a rear wall surface of the panel;

a shift lever rotatably held in the opening portion of the panel, where the shift lever includes a rotation center portion, a driving portion and an operation portion, the rotation center portion is located in the opening portion of the panel and connected with the panel, the rotation center portion is connected with each of the driving portion and the operation portion, the driving portion extends from the rotation center portion to an outside of the rear wall surface of the panel, and the operation portion extends from the rotation center portion to an outside of the front wall surface of the panel;

a fixed contact, where the fixed contact is provided on the rear wall surface of the panel, and located within an area reachable by the driving portion through rotation; and an elastic element, where both ends of the elastic element are connected with the shift lever and the panel, respectively; where a fit clearance between the rotation center portion and the opening portion ranges from 0.02 mm to 0.2 mm.

As an improvement of the above technical solution, the front wall surface of the panel is connected with a flow guiding portion, the flow guiding portion is formed by connecting a plurality of flow guiding wall surfaces end-to-end in sequence along an outer contour of the front wall surface of the panel, and the flow guiding portion is of a truncated pyramid shape.

As a further improvement of the above technical solution, the rotation center portion is provided with a stepped portion, with the stepped portion arranged in a direction of a rotation axis of the shift lever.

As a further improvement of the above technical solution, the opening portion is provided with a stepped hole matching the stepped portion of the rotation center portion.

As a further improvement of the above technical solution, the shift lever is provided with a position limiting portion connected with the rotation center portion, the position limiting portion extends from the rotation center portion to the outside of the rear wall surface of the panel, and the position limiting portion can rotate to get contacted with the rear wall surface of the panel.

As a further improvement of the above technical solution, the position limiting portion and the driving portion are located on both sides of the opening portion, respectively.

As a further improvement of the above technical solution, the fixed contact is a microswitch.

As a further improvement of the above technical solution, the fixed contact is located above the opening portion.

As a further improvement of the above technical solution, the elastic element is a spring.

As a further improvement of the technical solution, the panel is provided with a snap joint for securing the waterproof toggle switch.

The beneficial effects of the present invention are as follows: by providing the panel with the opening portion and providing the shift lever with the rotation center portion, and by controlling the fit clearance between the opening portion and the rotation center portion, elements inside the switch are prevented from being wetted by water, and only a small number of structural members are needed, and therefore, a waterproof toggle switch having superperformance and a low cost is provided.

In order to enable the object, the features and the advantages of the present invention to be better understood, detailed description is given below by means of preferred embodiments in conjunction with the accompanying drawings.

BRIEF DESCRIPTION OF DRAWINGS

In order to illustrate technical solutions of embodiments of the present invention more clearly, drawings required to be used in the embodiments are introduced briefly below. It should be understood that the following drawings show only some of the embodiments of the present invention, and therefore shall not be regarded as limiting the scope of the present invention. For those ordinary skilled in the art, other related drawings can also be obtained according to these drawings without paying any inventive efforts.

DESCRIPTION ON REFERENCE SIGNS OF THE MAIN ELEMENTS

100—waterproof toggle switch, 010—panel, 011—opening portion, 011*a*—stepped hole, 012—front wall surface, 020—shift lever, 021—rotation center portion, 021*a*—stepped portion, 022—driving portion, 023—operation portion, 024—position limiting portion, 030—fixed contact, 040—elastic element, ζ—fit clearance, 050—flow guiding portion, 051—first wall surface, 052—second wall surface, 053—third wall surface, 054—fourth wall surface, and 060—snap joint.

DETAILED DESCRIPTION OF EMBODIMENTS

In order to facilitate understanding of the present invention, more comprehensive description on the waterproof toggle switch is given below with reference to the relevant figures. In the figures, preferred embodiments of the waterproof toggle switch are illustrated. However, the waterproof toggle switch can be implemented in many different ways, which is not limited to the embodiments described herein. Rather, the purpose of providing these embodiments is to make the disclosure of the waterproof toggle switch more thorough and comprehensive.

It should be noted that, if an element is described as being "fixed to" another element, this element can be directly on the another element or there may also be an intermediate element. If one element is regarded as being "connected" to another element, this element can be directly connected to the another element or there may also be an intermediate element. However, if an element is described as being "directly on" another element, there is no intermediate element. Terms "vertical", "horizontal", "left", "right" and the like used herein are only for illustrative purpose.

Unless otherwise defined, all of the technical and scientific terms used herein have the same meaning as that commonly construed by those skilled in the art to which the present invention belongs. The terms used in the description of the waterproof toggle switch only serve the purpose of describing particular embodiments, rather than limiting the present invention. The term "and/or" used herein includes any and all of the combinations of one or more associated listed items.

First Embodiment

Figure 1:
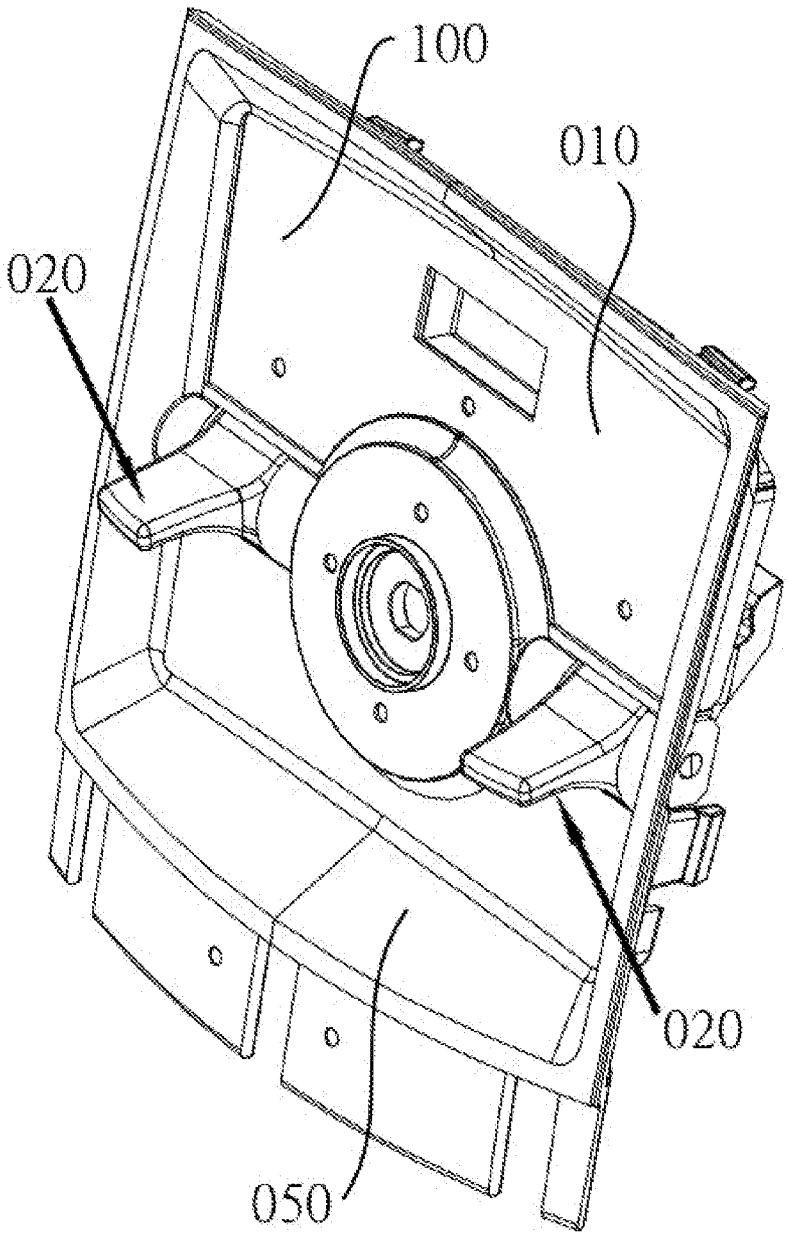
FIG. 1 is a view showing an overall assembled structure of a waterproof toggle switch provided by a first embodiment of the present invention.
Figure 2:
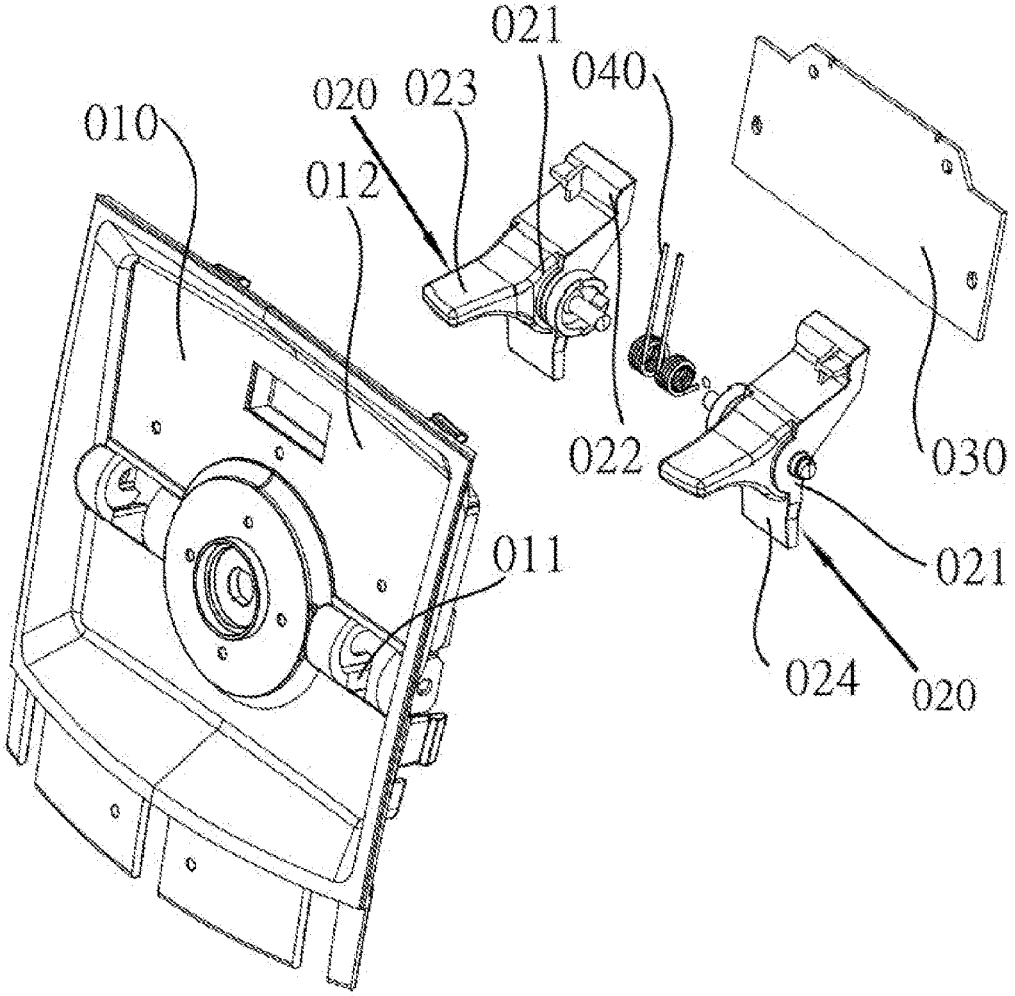
FIG. 2 is an exploded view of the overall structure of the waterproof toggle switch provided by the first embodiment of the present invention.

Referring to FIG. 1 and FIG. 2, a waterproof toggle switch 100 includes a panel 010, a shift lever 020, a fixed contact 030 and an elastic element 040.

The panel 010 is the main housing of the waterproof toggle switch 100, a front wall surface 012 of the panel is the main appearance surface, and a rear wall surface of the panel can be connected with a circuit that needs to be controlled. The panel 010 is provided with an opening portion 011 running through the panel, between the front wall surface and the rear wall surface of the panel, for providing a receiving space necessary for receiving the shift lever 020.

The shift lever 020 is the main executive member for performing the switching operation, and it is rotatably held in the opening portion 011 of the panel 010. In other words, the shift lever 020 can rotate in the opening portion 011, so as to enable the waterproof toggle switch 100 to be switched on or off.

The fixed contact 030 is provided on the rear wall surface of the panel 010, and the fixed contact is located within an area reachable by a driving portion 022 through rotation, for receiving an operation signal from the shift lever 020. When the fixed contact 030 gets contacted with the driving portion 022, the circuit is switched on; on the contrary, when the fixed contact 030 does not get contacted with the driving portion 022 and is thus in a free state, the circuit is switched off.

In a preferred embodiment, the fixed contact 030 is a microswitch. The microswitch is electrically connected with the circuit that needs to be controlled, and a housing is covered on the microswitch, with the housing provided thereon with a trigger portion used for receiving a pressure. With such a structure, the driving portion 022 does not have to be directly connected with the circuit that needs to be controlled, which greatly simplifies the internal circuit structure of the waterproof toggle switch 100.

In particular, the microswitch may be directly installed on a printed circuit board, which further simplifies the internal circuit structure of the waterproof toggle switch 100, and thus the waterproof performance of the waterproof toggle switch 100 is further improved.

Under the mechanical action of the driving portion 022, the microswitch is pressed and is thus turned on, so as to make the circuit switched on. Since the driving portion 022 is connected with the internal circuit of the waterproof toggle switch 100 only by means of the mechanical action, that is, there is no current flow between the drive portion and the internal circuit of the waterproof toggle switch, which further improves the waterproof effect of the waterproof toggle switch 100.

In another embodiment, the driving portion 022 may also be provided thereon with a rotational contact, with the rotational contact electrically connected with the circuit that needs to be controlled. The fixed contact 030 is also electrically connected with the circuit that needs to be controlled. When the fixed contact 030 gets contacted with the rotational contact of the driving portion 022, a complete loop is formed in the circuit that needs to be controlled, so that the circuit is switched on.

Both ends of the elastic element 040 are connected with the shift lever 020 and the panel 010, respectively. An elastic force is generated through elastic deformation of the elastic element, so as to provide a constraint force to keep the shift lever 020 being in a stable state, thereby keeping the waterproof toggle switch 100 switched on or off.

In a preferred embodiment, the elastic element 040 is a spring, and both ends of the spring are connected with the panel 010 and the rotation center portion 021, respectively. After the shift lever 020 is rotated to its position, the spring exerts an elastic force to the shift lever 020, so that the shift lever 020 stays still. In the case where the elastic element 040 is a torsion spring, a better effect would be provided.

Figure 3:
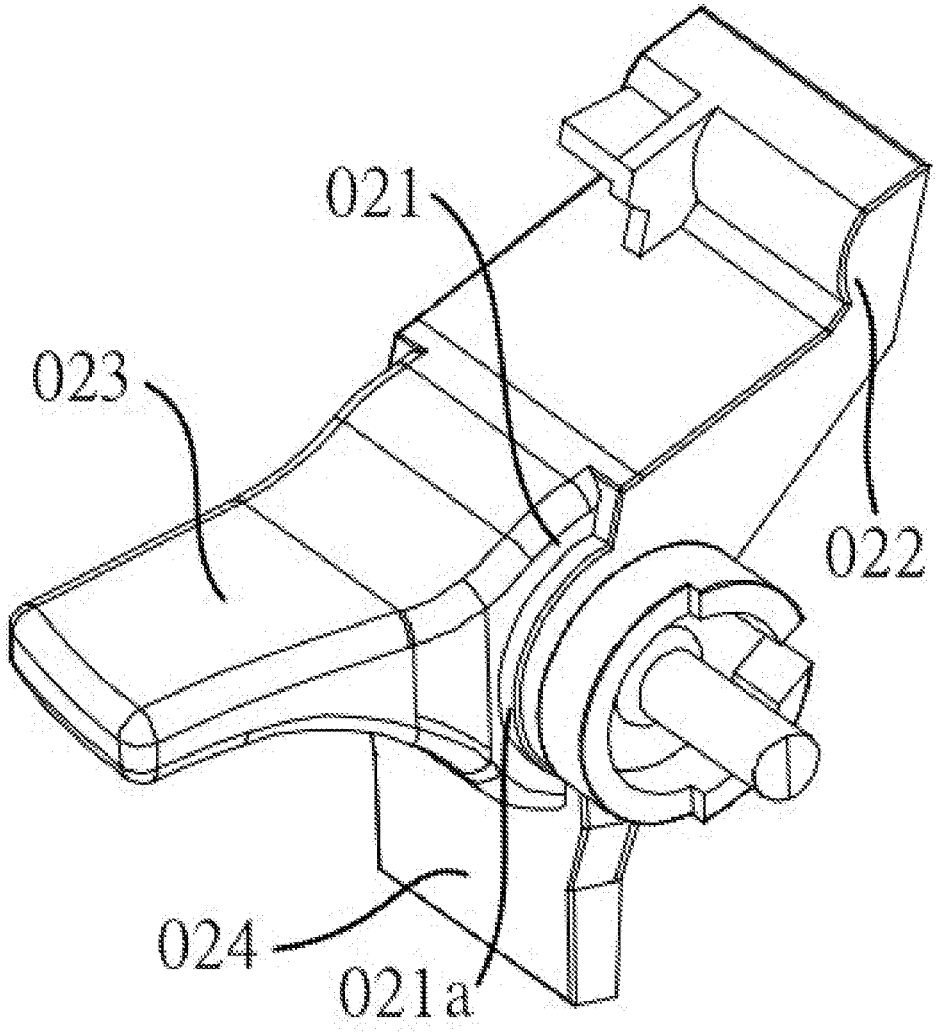
FIG. 3 is a structural view of a shift lever of the waterproof toggle switch provided by the first embodiment of the present invention.
Figure 4:
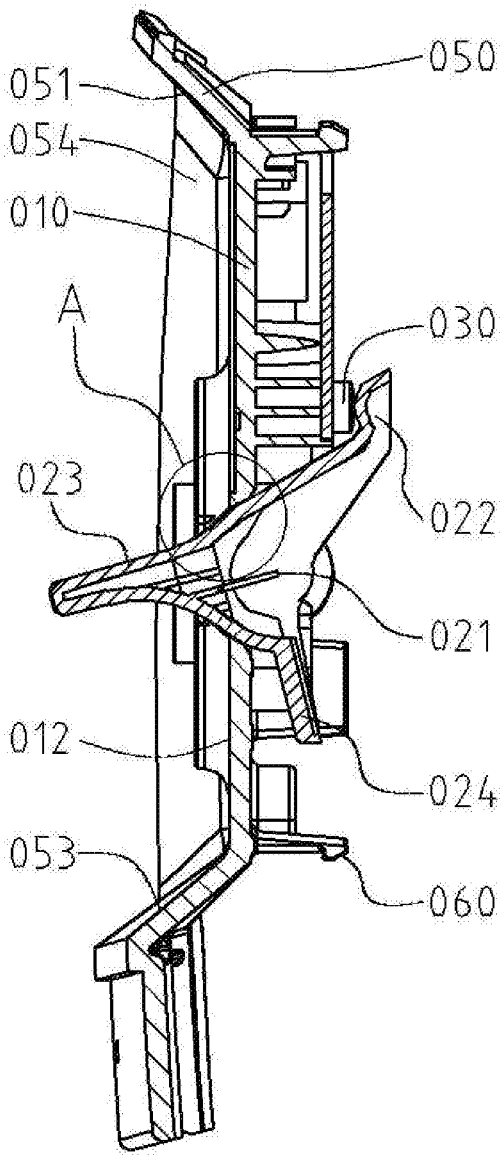
FIG. 4 is a side section view of the waterproof toggle switch provided by the first embodiment of the present invention.

Referring to FIG. 3 and FIG. 4, the shift lever 020 includes a rotation center portion 021, the driving portion 022 and an operation portion 023. The rotation center portion 021 is located in the opening portion 011 of the panel 010 and connected with the panel 010. The rotation center portion 021 is connected with each of the driving portion 022 and the operation portion 023. The driving portion 022 extends from the rotation center portion 021 to the outside of the rear wall surface of the panel 010, and the operation portion 023 extends from the rotation center portion 021 to the outside of the front wall surface 012 of the panel 010.

Specifically, the rotation center portion 021 is in clearance fit with the opening portion 011 in each direction, and can rotate freely in a vertical plane within the opening portion 011.

The operation portion 023 is located outside of the front wall surface 012 of the panel 010; and when being pushed by a user, the operation portion can get close to or away from the front wall surface 012 of the panel 010 in a rotate mode. Whereby, the operation portion 023 drives the rotation center portion 021 to rotate, and the rotation center portion 021 in turn drives the driving portion 022 to rotate, so as to realize the rotation of the entire shift lever 020.

The driving portion 022 is located outside of the rear wall surface of the panel 010; and as the rotation center portion 021 rotates, the drive portion may get close to or away from the rear wall surface of the panel 010 in a rotate mode. Since the fixed contact 030 is located within the area reachable by the driving portion 022 through rotation, the driving portion 022 can get close to or away from the fixed contact 030 through rotation. If the driving portion 022 gets close to and thus gets contacted with the fixed contact 030 through rotation, the fixed contact 030 is pressed so as to make the circuit switched on; and if the driving portion 022 gets away from the fixed contact 030 through rotation, the fixed contact 030 is in a free state and the circuit is switched off.

Furthermore, the panel 010 is further provided thereon with a snap joint 060 for securing the waterproof toggle switch 100. The snap joint 060 can be directly snapped into a target device, so that the waterproof toggle switch 100 is firmly connected with the target device. In this way, the installation can be implemented without any additional tools, which is quite convenient.

In the case where the waterproof toggle switch 100 is used for kitchen or bathroom electrical products, the environment is humid, i.e. being water-saturated, the water enters the interior of the waterproof toggle switch 100 mainly through the clearance between the rotation center portion 021 and the opening portion 011.

Generally, the water intrudes into the switch mainly in two ways, with the two ways including intrusion of water flow and intrusion of water drops. The intrusion of water flow mainly means that a jet flow with a certain pressure breaks through the clearance under the action of the pressure, and can thus easily enter the interior of the switch, thereby causing an electric leakage of the switch. The intrusion of water drops mainly means that a small amount of water flowing slowly enters the interior of switch by slow wetting, or stays at the operation region, which easily incurs an electric shock and also poses a serious threat to the electric safety of the switch.

Figure 5:
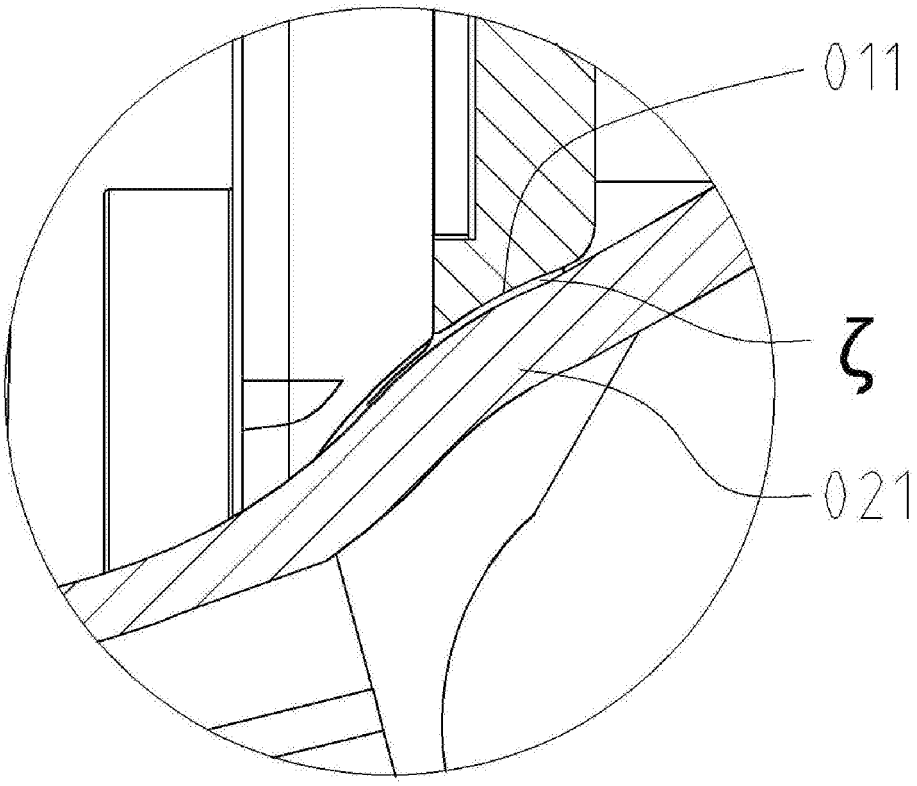
FIG. 5 is an enlarged view of part A of the waterproof toggle switch shown in FIG. 4.

To this end, referring to FIG. 5, the fit clearance ζ between the rotation center portion 021 and the opening portion 011 is defined to be in a range from 0.02 mm to 0.2 mm (both endpoint values are included), so that the waterproof toggle switch 100 has a good waterproof performance. Within the range of the fit clearance, the rotation center portion 021 and the opening portion 011 fit tightly in each direction. It is difficult for water to enter the interior of the waterproof toggle switch 100, which provides good protection for the internal components of the waterproof toggle switch 100.

In the case where the waterproof toggle switch 100 faces the intrusion of water drops, as the fit clearance ζ is only 0.02-0.2 mm, the effect of surface tension of the water drops is very obvious, and the water drops are guided to pass through the fit clearance ζ orderly, and finally the water drops are discharged from the waterproof toggle switch 100 at the rear wall surface of the panel 010. The flow guiding action of the fit clearance ζ prevents the water drops from accumulating at the operation portion 023, so that the operation portion 023 stays dry. Therefore, the user will not get an electric shock, thereby effectively ensuring the electric safety.

In the case where the waterproof toggle switch 100 faces the intrusion of water flow, the straight-through water flow is blocked under the combined action of the strictly controlled fit clearance ζ and the front wall surface of the panel 010, and it is thus difficult for the water flow to cause damage to the internal elements of the waterproof toggle switch 100. A part of the water flow is deflected and thus goes away from the panel 010, and the remaining water flow rapidly goes downwards along the front wall surface 012 of the panel 010, and finally goes out of the range of the front wall surface 012 of the panel 010. The residual water drops on the operation portion 023 fit the situation of the intrusion of water drops, and are discharged under the flow guiding action of the fit clearance ζ.

Obviously, under this structural relationship, the water can neither cause damage to the internal components of the waterproof toggle switch 100, nor residue on the surface of the waterproof toggle switch 100, thereby avoiding the possibility of electric shocks.

In a more preferred embodiment, the fit clearance ζ between the rotation center portion 021 and the opening portion 011 ranges from 0.05 mm to 0.1 mm (both endpoint values are included). In this numerical range, the rotation center portion 021 has a better flexibility of rotation, and both the blocking action on the water and the flow guiding action are further enhanced, which enables the waterproof toggle switch 100 to have a better effect.

Figure 6:
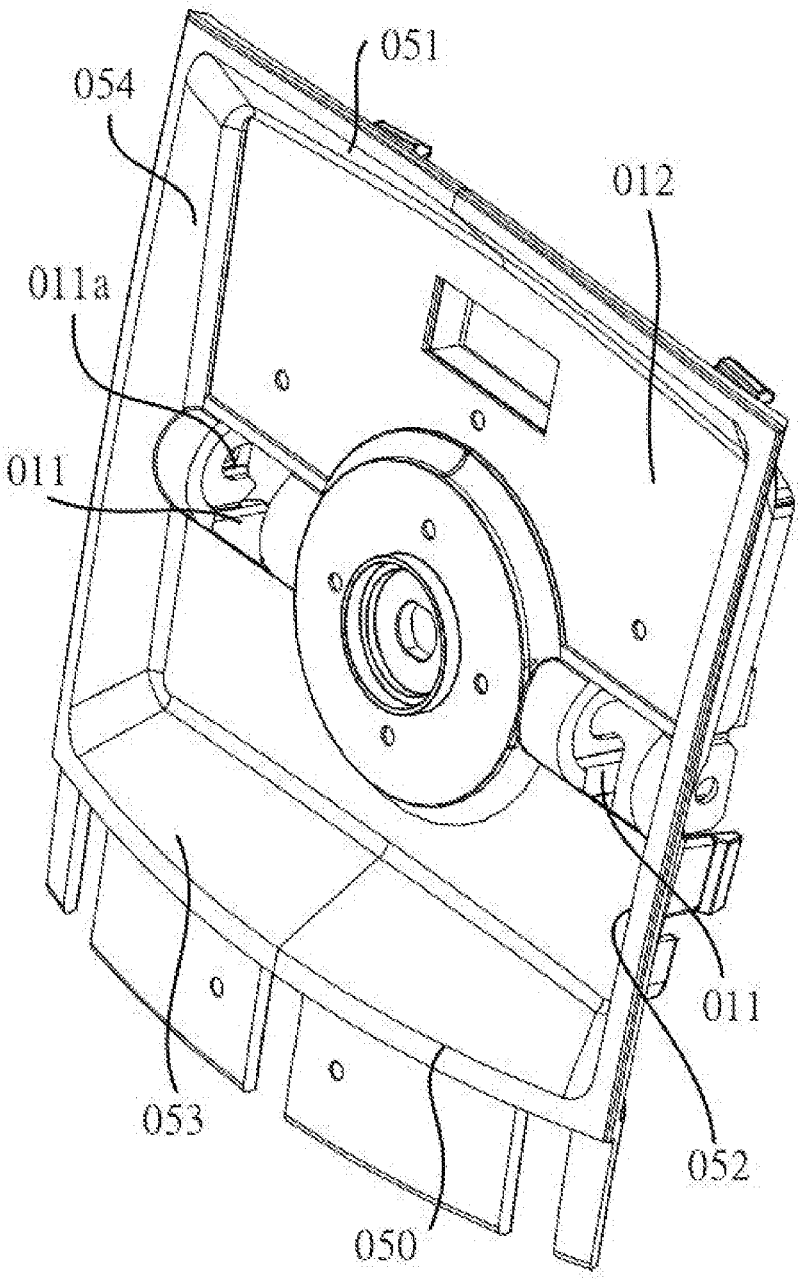
FIG. 6 is a structural view of a panel of the waterproof toggle switch provided by the first embodiment of the present invention.

Referring to FIG. 6, furthermore, the front wall surface 012 of the panel 010 is connected with a flow guiding portion 050. The flow guiding portion 050 is formed by connecting a plurality of flow guiding wall surfaces end-to-end in sequence along an outer contour of the front wall surface 012 of the panel 010. The flow guiding portion 050 is of a truncated pyramid shape.

The so-called truncated pyramid refers to a portion between the bottom surface of a pyramid and a cross profile of the pyramid. In a preferred embodiment, the truncated pyramid is a portion between the bottom surface of a pyramid and a cross profile of the pyramid that is parallel to the bottom surface.

In a preferred embodiment, the flow guiding portion 050 is formed by connecting a first wall surface 051, a second wall surface 052, a third wall surface 053 and a fourth wall surface 054 end-to-end in sequence along the outer contour of the front wall surface 012 of the panel 010, in such a manner that the flow guiding portion has a truncated pyramid shape. The flow guiding portion 050 has a hollow interior, where an opening is formed which extends from the front end to the rear end of the flow guiding portion, and a rear end surface of the flow guiding portion is connected with the front wall surface 012 of the panel 010.

The flow guiding portion 050 is in the shape of a truncated pyramid, with the bottom surface of the truncated pyramid being the bottom surface of a pyramid, the top surface of the truncated pyramid being a cross profile of the pyramid, and the area of the bottom surface of the truncated pyramid being larger than that of the top surface of the truncated pyramid. In other words, the area of a front end surface of the flow guiding portion 050 is larger than that of the rear end surface of the flow guiding portion 050, with the projection contour of the front end surface of the flow guiding portion 050 on the front wall surface 012 of the panel 010 encompassing the contour of the rear end surface of the flow guiding portion 050.

Under this structure, the lower contour line of the panel 010 is located above the third wall surface 053. Under the action of gravity, the water flow naturally travels, along the front wall surface 012 of the panel 010, towards the third wall surface 053, and goes away quickly via the third wall surface 053. Therefore, there is no accumulation of water, as the flow guiding effect of the waterproof toggle switch 100 is further improved.

Figure 7:
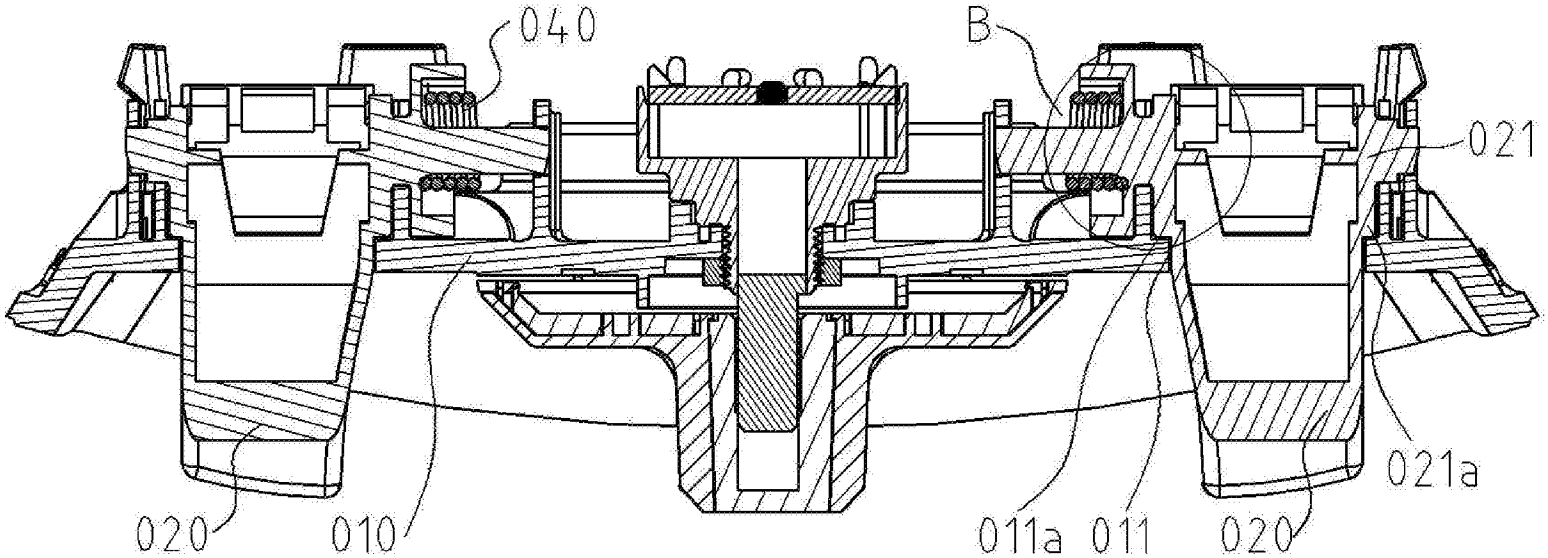
FIG. 7 is a section view of the waterproof toggle switch provided by the first embodiment of the present invention, as seen from above.
Figure 8:
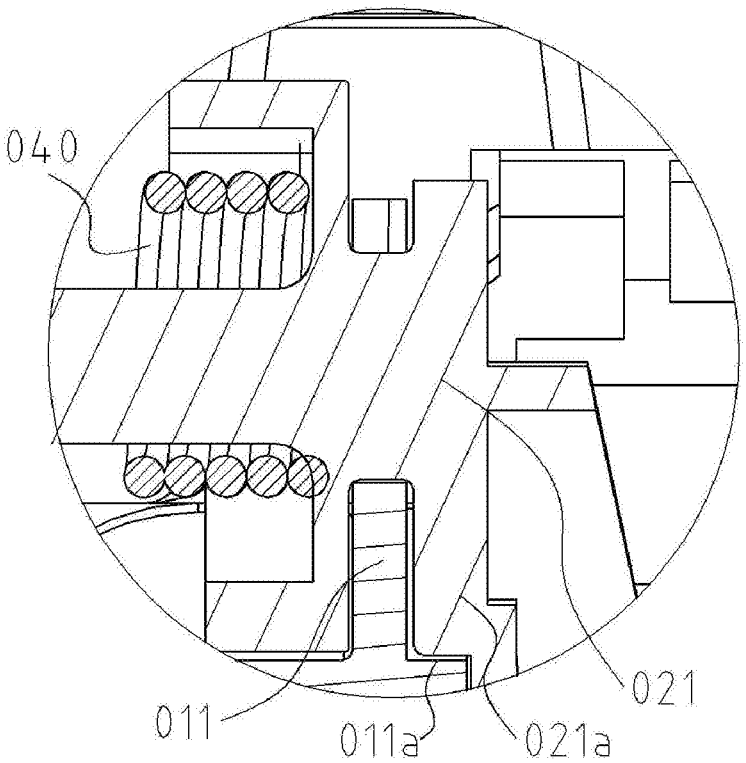
FIG. 8 is an enlarged view of part B of the waterproof toggle switch shown in FIG. 7.

Referring to FIG. 7 and FIG. 8, furthermore, the rotation center portion 021 is provided with a stepped portion 021*a* along the direction of a rotation axis of the shift lever 020, and the opening portion 011 is provided with a stepped hole 011*a* matching the stepped portion 021*a* of the rotation center portion 021. A turning fit is provided between the stepped portion 021*a* and the stepped hole 011*a*, which further enhances the effect of the surface tension of the water drops, so that the water drops can be guided more rapidly, and the flow guiding effect of the fit clearance ζ is better.

In a preferred embodiment, the stepped portion 021*a* includes a plurality of steps, and the height of each step is not smaller than the value of the fit clearance ζ.

The shift lever 20 is provided with a position limiting portion 024 connected with the rotation center portion 021. The position limiting portion 024 extends from the rotation center portion 021 to the outside of the rear wall surface of the panel 010, and the position limiting portion 024 can rotate to get contacted with the rear wall surface of the panel 010.

Furthermore, the position limiting portion 024 and the driving portion 022 are located on both sides of the opening portion 011, respectively. The elastic element 040 cooperates with each of the driving portion 022 and the position limiting portion 024, so that the position of the shift lever 020 is limited, which prevents the stability of the waterproof toggle switch 100 from being affected by an excessive rotational motion or a shake of the shift lever 020.

Specifically, in the process of switching on the waterproof toggle switch 100, the driving portion 022 gets close to and thus gets contacted with the fixed contact 030 through rotation, and then is subjected to a resistance so that the shift lever 020 stops rotating. Thereafter, the shift lever 020 stays still under the restraining actions of the elastic element 040 and the fixed contact 030, so that the waterproof toggle switch 100 is kept in a switched-on state.

In the process of switching off the waterproof toggle switch 100, the position limiting portion 024 rotates to get contacted with the rear wall surface of the panel 010, and is thus subjected to a resistance so that the shift lever 020 stops rotating. Thereafter, the shift lever 020 stays still under the restraining actions of the elastic element 040 and the rear wall surface of the panel 010, so that the waterproof toggle switch 100 is kept in a switched-off state.

Furthermore, the position limiting portion 024 can tightly fit the rear wall surface of the panel 010, with a relatively small clearance left therebetween. In this way, the surface tension of the water guided through the fit clearance ζ is optimized, and therefore the water flows downwards rapidly along the rear wall surface of the panel 010, thereby further improving the waterproof effect of the waterproof toggle switch 100.

Furthermore, in a preferred embodiment, the fixed contact 030 is located above the opening portion 011. Accordingly, the circuit, which is connected with the fixed contact 030 and needs to be controlled, is also located above the opening portion 011. As water flows downwards under the action of gravity, the possibility that the fixed contact 030 and the circuit that needs to be controlled are exposed to water is further reduced.

In all the examples shown and described herein, any specific value should be interpreted as being merely exemplary, rather than being limiting, and therefore other examples of the exemplary embodiments may have different values.

It should be noted that like reference signs and letters denote like items in the following figures. Thus, once a certain item is defined in one figure, it does not need to be further defined or explained in the subsequent figures.

The above embodiments only illustrate several implementations of the present invention. Although these embodiments are described in a specific and detailed manner, they shall not be construed as limiting the scope of the present invention. It should be noted that, for those ordinary skilled in the art, some variations and modifications can be made without departing from the concept of the present invention, and all of them should fall within the scope of protection of the present invention. Therefore, the scope of protection of the present invention shall be determined by the appended claims.

What is claimed is:

1. A waterproof toggle switch, comprising:

a panel provided with an opening portion, with the opening portion running through the panel, between a front wall surface and a rear wall surface of the panel;

a shift lever rotatably held in the opening portion of the panel, wherein the shift lever comprises a rotation center portion, a driving portion and an operation portion, the rotation center portion is located in the opening portion of the panel and connected with the panel, the rotation center portion is connected with each of the driving portion and the operation portion, the driving portion extends from the rotation center portion to an outside of the rear wall surface of the panel, and the operation portion extends from the rotation center portion to an outside of the front wall surface of the panel;

a fixed contact, wherein the fixed contact is provided on the rear wall surface of the panel, and located within an area reachable by the driving portion through rotation; and an elastic element, wherein both ends of the elastic element are connected with the shift lever and the panel, respectively; wherein a fit clearance between the rotation center portion and the opening portion ranges from 0.02 mm to 0.2 mm.

2. The waterproof toggle switch according to claim 1, wherein the front wall surface of the panel is connected with a flow guiding portion, the flow guiding portion is formed by connecting a plurality of flow guiding wall surfaces end-to-end in sequence along an outer contour of the front wall surface of the panel, and the flow guiding portion is of a truncated pyramid shape.

3. The waterproof toggle switch according to claim 1, wherein the rotation center portion is provided with a stepped portion, with the stepped portion arranged in a direction of a rotation axis of the shift lever.

4. The waterproof toggle switch according to claim 3, wherein the rotation center portion is located within the opening portion, and the opening portion is provided with a stepped hole matching the stepped portion of the rotation center portion.

5. The waterproof toggle switch according to claim 1, wherein the shift lever is provided with a position limiting portion connected with the rotation center portion, the position limiting portion extends from the rotation center portion to the outside of the rear wall surface of the panel, and the position limiting portion can rotate to get contacted with the rear wall surface of the panel.

6. The waterproof toggle switch according to claim 5, wherein the shift lever comprises the driving portion, the panel is provided with the opening portion, and the position limiting portion and the driving portion are located on both sides of the opening portion, respectively.

7. The waterproof toggle switch according to claim 1, wherein the fixed contact is a microswitch.

8. The waterproof toggle switch according to claim 1, wherein the fixed contact is located above the opening portion.

9. The waterproof toggle switch according to claim 1, wherein the elastic element is a spring.

10. The waterproof toggle switch according to claim 1, wherein the panel is provided with a snap joint for securing the waterproof toggle switch.

* * * * *